US006545413B1

(12) United States Patent
Takahashi et al.

(10) Patent No.: US 6,545,413 B1
(45) Date of Patent: Apr. 8, 2003

(54) METAL HALIDE LAMP

(75) Inventors: Kiyoshi Takahashi, Neyagawa (JP); Makoto Horiuchi, Sakurai (JP); Mamoru Takeda, Soraku-gun (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/168,966

(22) Filed: Oct. 9, 1998

(30) Foreign Application Priority Data

Oct. 13, 1997 (JP) ..... 9-278400
Sep. 21, 1998 (JP) ..... 10-266281

(51) Int. Cl.[7] ..... H01J 17/04; H01J 17/20
(52) U.S. Cl. ..... 313/620; 313/639
(58) Field of Search ..... 313/567, 605, 313/620, 634, 637, 638, 639, 640–643, 571, 4

(56) References Cited

U.S. PATENT DOCUMENTS

| | | | | |
|---|---|---|---|---|
| 3,351,798 A | * | 11/1967 | Bauer | 313/225 |
| 3,654,506 A | * | 4/1972 | Kuhl et al. | 313/184 |
| 3,911,308 A | * | 10/1975 | Akustu et al. | 313/184 |
| 4,161,672 A | * | 7/1979 | Cap et al. | 313/220 |
| 4,232,243 A | | 11/1980 | Rigden | 313/217 |
| 4,308,483 A | | 12/1981 | Keeffe et al. | 313/214 |
| 4,594,529 A | * | 6/1986 | De Vrijer | 313/571 |
| 4,799,135 A | * | 1/1989 | Inukai et al. | 362/296 |
| 4,866,342 A | * | 9/1989 | Ramaiah et al. | 313/639 |
| 5,059,865 A | | 10/1991 | Bergman et al. | 315/82 |
| 5,109,181 A | | 4/1992 | Fischer et al. | |
| 5,221,876 A | | 6/1993 | Bergman et al. | 315/82 |
| 5,225,738 A | | 7/1993 | Ramaiah et al. | 313/641 |
| 5,334,906 A | | 8/1994 | Muzeroll | 313/25 |
| 5,451,838 A | * | 9/1995 | Kawai | 313/638 |
| 5,773,932 A | * | 6/1998 | Ooyama et al. | 313/639 |
| 5,942,850 A | * | 8/1999 | Rutan et al. | 313/571 |

FOREIGN PATENT DOCUMENTS

| | | |
|---|---|---|
| EP | 0581423 | 2/1994 |
| EP | 0762477 | 3/1997 |
| JP | 61-245458 | 10/1986 |
| JP | 64-1902 | 1/1989 |
| JP | 1-255149 | 10/1989 |
| JP | 2-148561 | 6/1990 |
| JP | 07-192688 | 7/1995 |
| JP | 7-296782 | 11/1995 |
| JP | 08-329901 | 12/1996 |

OTHER PUBLICATIONS

"Characteristics and Theoretical Analysis of Metal Halide Lamps", pp. 566–573 1989 (no month).
"Complex Halide Vapors in Metal Halide Type Hid Lamps"; C. Hirayama et al.; pp. 209–214; Jul. 1977.

* cited by examiner

*Primary Examiner*—Nimeshkumar D. Patel
*Assistant Examiner*—Thelma Sheree Clove
(74) *Attorney, Agent, or Firm*—Parkhurst & Wendel, LLP

(57) ABSTRACT

A fill material 201 enclosed in an arc tube 201 with an inner diameter of 10.8 mm includes $ScI_3$, argon, and mercury. A distance between electrodes 202 is set at 2.2 mm, and a distance between the inner wall of the arc tube 201 and the electrodes 202 is set at approximately 5.4 mm, which is approximately twice the distance between the electrodes 202. The lamp of the present invention is capable of forming thin arc and thereby achieving high luminance since only the metallic elements having an ionization potential of 6 eV or higher is contained in the fill material 207. The restriction of the short distance between the electrodes serves to stabilize arc. Scandium in the fill material serves to achieve a good color reproduction characteristic.

14 Claims, 10 Drawing Sheets

207:Fill material
($ScI_3$+Argon+Mercury)

207:Fill material
($ScI_3$+Argon+Mercury)

METAL HALIDE LAMP

BACKGROUND OF THE INVENTION (1) Field of the Invention

This invention relates to a metal halide lamp, and more particularly to a metal halide lamp utilized for a projection display such as a liquid crystal projection display, and for a luminance mainly incorporated into a reflector and the like.

(2) Description of the Prior Art

Liquid crystal projection systems have been gaining popularity as a display means for magnifying and projecting characters or graphics on the screen.

This type of apparatus typically has such a construction that a light from a light source lamp is projected into a liquid crystal panel via a reflector and subsequently the light is projected onto a screen via a focusing optical system, which is a projecting optical system. Having such a construction, this type of apparatus can utilize only the light emitted from a limited region adjacent to the focal point of the reflector. It is therefore desirable that, in a lamp for the light source, the light emission by arc be concentrated in as small an area as possible. The reason is that the. efficiency in utilizing light increases as the light emitting area becomes smaller, thus achieving high illuminance at the screen. This tendency becomes more apparent as reduction of the physical sizes of reflectors and the like advances in the attempts to reduce the size, weight, and cost of the projection devices.

It is also desirable that the lamp used for the light source of projection systems have well-balanced light emission throughout the whole visible range of spectrum. In other words, if the lamp exhibits well-balanced light emission in each red, green, and blue region of spectrum, the projection system employing the lamp will be thereby able to reproduce, for example, an image of healthy human's complexion as it should be. However, if the light emission in the red region is insufficient, the displayed image of the healthy human's complexion turns out to be bluish, thus pale and unhealthy.

In consideration of the above, metal halide lamps, ultra high-pressure mercury lamps, or the like have been used for conventional liquid crystal projection displays and the like.

Metal halide lamps are a high-pressure discharge lamp characterized in that various types of metal halides are contained in high-pressure mercury vapor. One type of such a lamp is disclosed on pp. 18–24 of *Characteristics and Theoretical Analysis of Metal Halide Lamps*, T. Higashi, The Journal of the Illuminating Engineering Institute of Japan, Vol. 73, No. 9, 1989. The lamp includes the iodides of Sc (scandium) and Na (sodium) in the fill material, and exhibits a high luminous efficacy of 90 lm/W. (It is to be understood that the term 'luminous efficacy' herein means a luminous flux per unit input electric power to a lamp.) The reason for this is considered to be that a complex iodide possibly $Na_2ScI_5$), which has a higher vapor pressure than that of Sc and Na as a simple body, is formed from Sc and Na therein. (See pp. 209–214 of *Complex Halide Vapors in Metal Halide Type HID Lamps*, C. Hirayama et al., The Journal of the Illuminating Engineering Society, July 1977). The special distribution of this lamp is shown in FIG. 7. As seen from FIG. 7, a large number of bright-line spectrums are observed in the visible range, which indicates that the lamp has relatively high color rendering properties.

In the process of completing the invention, the present inventors experimentally produced a metal halide lamp having a construction described below and shown in FIG. 8. The lamp has an arc tube 101, composed of a light-transmissive quartz vessel having an approximately spherical shape, an inner diameter of 10.8 mm, and an inner capacity of 0.7 cc. Each of the opposite ends of the arc tube 101 is sealed at a seal portion 106. A pair of tungsten electrodes 102 is provided within the arc tube 101. Each of the tungsten electrodes 102 is connected to an external lead 104 via a molybdenum foil 103. A tungsten coil 105 is also connected to each of the tungsten electrodes 102 by welding. The gap between the terminal ends of the electrodes 102 (the distance between the electrodes) is set at 2.2 mm. A fill material 107 is enclosed in the arc tube 101. The fill material 107 comprises 0.6 mg of InI (indium iodide), 1 mg of $TmI_3$ (thulium iodide), argon with 0.2 atm at a room temperature, and 49 mg of mercury.

The luminous efficacy of the lamp according to the above-described construction was about 80 lm/W when the lamp was disposed horizontally and operated at a rated input power. The luminous flux that reaches a 40-inch screen was measured under the condition where the light emitted from the lamp is projected with a taking angle of 7 degrees via an ellipsoidal reflector. The size of the luminous flux per unit input power was 4 lm/W. The size of the luminous flux per unit power measured according to the above-described manner is hereinafter referred to as 'projection efficiency'. It is to be noted here that conventional well known metal halide lamps have a longer distance between the electrodes (for example, approx. 3 mm), and therefore exhibit even lower projection efficiency than the above-described lamp. As to the spectral distribution, the lamp exhibited abundant light emission over the whole visible range, as shown in FIG. 9. In particular, the light emission in the red region of spectrum was more abundant than that of the previously-mentioned metal halide lamp comprising iodides of Sc and Na, which leads to more favorable color reproduction properties when the lamp is used for projecting image and the like.

An ultra high-pressure mercury lamp, for example, as the one described in Japanese Unexamined Patent Publication No. 2-148561, generally has such a construction that mercury is primarily included in the fill material and the vapor pressure of the mercury becomes very high during the operation. Halides of other metals are not included therein. An ultra high-pressure mercury lamp of this type exhibited a luminous efficacy of about 60 lm/W and a projection efficiency of 11 lm/W, when operated at a rated power. The spectral distribution of this lamp is shown in FIG. 10. Since this type of ultra high-pressure mercury lamp is operated with high vapor pressure, the light emission in the red region of spectrum, the wavelength range of around 600 to 650 nm, is a little improved over other types of mercury lamps which is operated with lower vapor pressure. Nonetheless, the amount of light emission in the red region of around 600 to 650 nm is still obviously smaller than that of the metal halide lamps mentioned above.

Now, the drawbacks of these prior art lamps will be further detailed below.

Although the above-described experimental metal halide lamp has relatively high luminous efficacy, it has a drawback in that the lamp cannot achieve high projection efficiency. This is due to the difficulty of making the light emitting area smaller. In consideration of this, as an index to indicate the size of the light emitting area, are diameters were measured for those lamps. From the results, it was confirmed that the experimental metal halide lamp containing In had a larger arc diameter of 1.1 mm than the ultra high-pressure mercury lamp, whose arc diameter was 0.7 mm. The metal halide lamp containing Na too has a drawback of larger arc diameter than the ultra high-pressure mercury lamp. Hence, these lamps cannot attain sufficient brightness at the screen in case where the lamps have a small reflector or a small to angle for the projection lens in the projecting optical system The reason for a large arc diameter in these lamps is that alkali metals such as Na and the like have low ionization potential as a simple body, for example, a ionization potential of Na being 5.14 eV, therefore easily ionize even in the low-temperature, peripheral area of the arc in the lamps. The alkali metals therefore generate free electrons, resulting in a wide electric current path, i.e., resulting in a large arc diameter. This is detailed on p.220 of *Electric Discharge Lamps*, John F. Waymouth, The MIT Press.

On the other hand, as mentioned above, the ultra high-pressure mercury lamp has a projection efficiency of 11 lm/W, and this is about three times the projection efficiency of the above-described metal halide lamp. However, although the light emission in the red region of spectrum is a little more improved than conventional mercury lamps, the ultra high-pressure mercury lamp cannot attain favorable well-balanced light emission over the whole visible range as can be achieved by metal halide lamps, since the luminophor thereof is limited to mercury.

In view of the above-mentioned problems, it is an object of the present invention to provide a metal halide lamp having a small arc diameter, high projection efficiency, and well-balanced light emission in terms of spectral distribution.

SUMMARY OF THE INVENTION

In accordance with the present invention, these and other objects are accomplished in a metal halide lamp having an arc tube in which a pair of electrodes is provided and a fill material comprising a rare gas and metallic elements including mercury is enclosed, the lamp being characterized in that each of the aforementioned metallic elements have a simple body ionization potential of 6 eV or higher, and that a distance between the terminal ends of the electrodes is set at such a distance that electric discharge therebetween is stably carried out, and that a distance between each of the terminal ends of the electrodes and the inner wall of the arc tube is set at not less than 1.5 times the distance between the terminal ends of the electrodes.

According to the above construction, thin arc is formed in the lamp by including in the fill material only the metallic elements with an ionization potential of 6 eV or higher. The lamp can thus attain high luminance and high projection efficiency, and high illuminance at a screen is thereby achieved In addition, unlike mercury lamps, the lamp according to the above construction can obtain a high level of color rendering properties with a favorable spectral distribution over the whole visible range of spectrum, since the luminophor is not limited to mercury as in mercury lamps.

In prior art metal halide lamps, Na or the like is added in the fill material in order to stabilize arc, However, it is considered that this is only necessary in the case where the distance between the electrodes is relatively long, e.g., approximately 10 mm. As the result of various experiments, the inventors have found that the formation of stable arc can be realized by restricting the distance between the electrodes at 2.5 mm or smaller, or preferably 2.0 mm or smaller, even if Na or the like is not added in the fill material, and that high luminance can be thereby achieved despite a low vapor pressure due to the absence of Na or the like.

Japanese Patent Publication No. 63-62066 discloses a lamp in which alkali metals are not included and the distance between terminal ends of the electrodes is made equal to the distance between the tube wall to the terminal ends of the electrodes. This technique is intended to realize stabilization of arc by the effect of the tube wall, and is effective for relatively low wattage lamps, for example the lamps with an input power of 50 to 70 W. However, for higher wattage lamps with a relatively short distance between the electrodes, this technique is not applicable since it leads to damage to the tube wall. By contrast, according to the present invention, the tube wall is kept away from the electrodes so that an input power to the lamp can be increased. In addition, according to the present invention, the distance between the electrodes is made short, and thus the invention can achieve the stabilization of arc and the increase in light emission.

It has been known in the art that the length of arc can be made short by making short the distance between the electrodes. However, it has not yet been made possible to extremely shorten the distance between the electrodes since such a short distance induces deterioration in operational life of the lamp.

On the other hand, the metal halide lamp according to the present invention requires smaller electric current than prior art metal halide lamps when operated at the same electric power More specifically, for example, assuming that the distance between the electrodes is 2 mm, in the case of the fill material including $ScI_3$ and NaI, the voltage between the electrodes is about 40 V, and therefore the required electric current is 5 A in order to attain an input power of 200 W. By contrast, in the case of the fill material not including NaI the voltage between the electrodes is about 60 V, and therefore the required electric current becomes 3.3 A, which is obviously smaller than the above case, to attain the same input power of 200 W. Hence, the present invention makes it possible to set a short distance between the electrodes, which serves to generate stable arc, without causing deterioration in the operational life of the lamp.

It is preferable that the above-mentioned metallic elements with an ionization potential of 6 eV or higher have the following properties.

1) High vapor pressure
2) Strong light emission in the visible range and well-balanced light emission
3) High ionization potential as a simple body For example, scandium can be employed for such a metallic element Scandium serves for a light emission around the wavelength of 630 nm, and therefore it is made possible by employing scandium to obtain a spectral distribution characteristic with abundant light emission in the red color region, the wavelength range of 600 to 650 nm. It is preferable that the scandium is in a halide form such as scandium iodide ($ScI_3$ and scandium bromide ($ScBr_3$) so that the enclosing of the scandium into the arc tube can be facilitated.

In addition, halides of rare-earth elements such as thulium iodide and the like may be enclosed in the arc tube so that the spectral distribution characteristic is further improved.

Furthermore, a light transmissive quartz tube may be employed for the arc tube. The light transmissive quartz tube has high transparency and small light dissipation compared to a ceramic tube for example, and therefore the advantage of small light emitting area achieved by thin arc becomes more apparent.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENT

Embodiment 1

Figure 1:
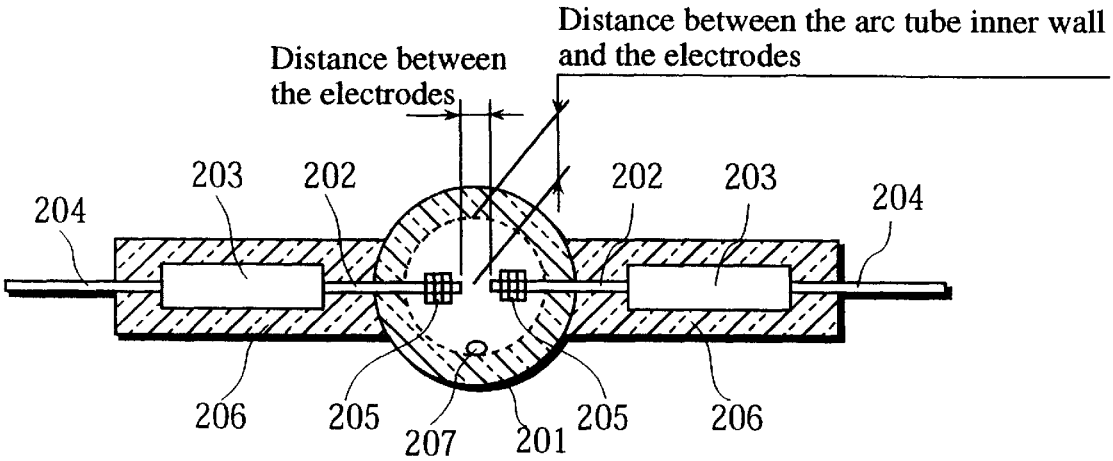
FIG. 1 is a cross-sectional view showing the construction of the metal halide lamp of the embodiment 1 according to the present invention.

Referring now to FIG. 1, there is shown a metal halide lamp of embodiment 1 according to the present invention. The metal halide lamp of the embodiment 1 has an approximately spherical-shaped arc tube 201, and a fill material 207 is enclosed in the arc tube 201. The arc tube 201 is composed of a light-transmissive vessel made of quartz. Each of the opposite ends of the arc tube 201 is sealed at a seal portion 206. A pair of tungsten electrodes 202 is provided within the arc tube 201. Each of the tungsten electrodes 202 is connected to an external lead 204 via a molybdenum foil 203 which is hermetically sealed in the seal portion 206. A tungsten coil 205 is also connected to each of the tungsten electrodes 202 by welding. The major dimensions in this metal halide lamp are as follows:

| | |
|---|---|
| Inner diameter of the arc tube: | 10.8 mm |
| Inner capacity of the arc tube: | 0.7 cc |
| Distance between the electrodes: | 2.5 mm |
| Distance between the arc tube inner wall and the terminal ends of the electrodes: | Approx. 5.4 mm |

The contents of the fill material 207 are as follows:

| | |
|---|---|
| $ScI_3$ (Scandium iodide): | 1 mg |
| Argon: | 0.2 atm (at room temperature) |
| Mercury: | 35 mg |

For a lamp constructed according to the above-described manner, an arc diameter of the lamp was measured under the conditions where the lamp was disposed horizontally, a voltage with a rectangular wave of 270 Hz was applied, and the voltage and electric current was controlled so that the lamp power was rated at 200 W.

Figure 2A:
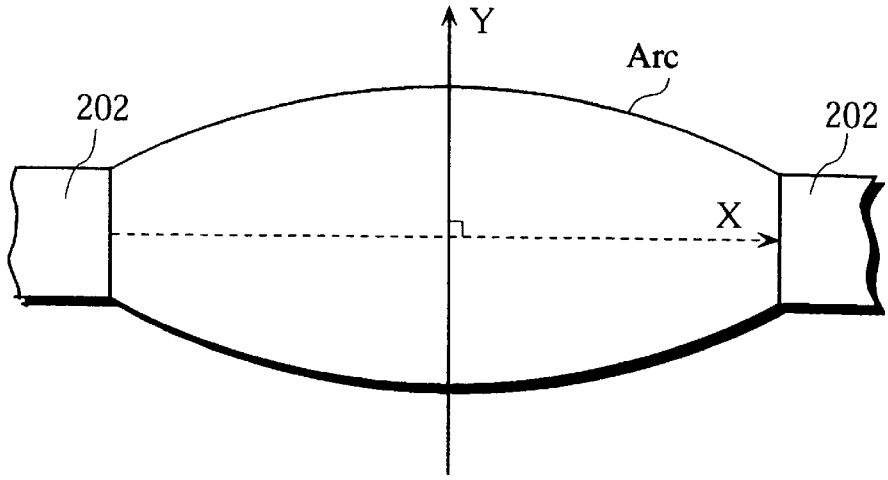
FIG. 2 is an explanatory diagram illustrating the definition of an arc diameter.
Figure 2B:
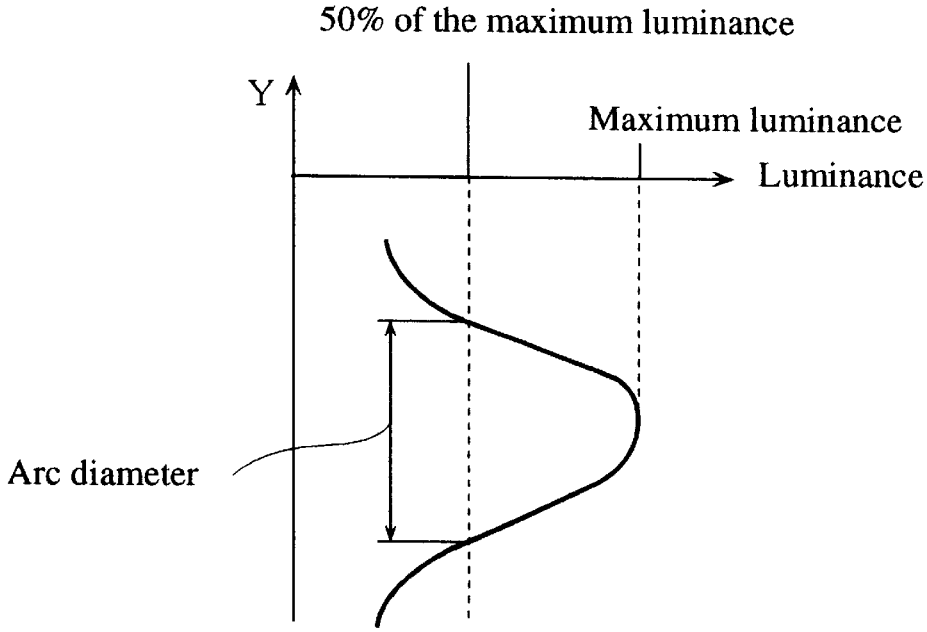

Now, with reference to FIG. 2(*a*) and FIG. 2(*b*), the definition of the term 'arc diameter' herein is given below. First, a line segment from one electrode 202 to the other electrode 202 is defined as an X-axis (an electrode axis), and a line segment orthogonal to the X-axis and crossing the halfway point between two electrodes is defined as a Y-axis. A distribution of luminance along the Y-axis is measured, and two points each with a luminance of 50% of the maximum luminance are determined The distance between the two points, each with a luminance of 50% of the maximum luminance, is defined as the 'arc diameter' herein.

The metal halide lamp of the embodiment 1 showed an arc diameter of 0.7 mm, when measured according to the above-described manner The value was obviously smaller than that of the experimental metal halide lamp as described hereinbefore, which was 1.1 mm, and approximately equal to that of the previously-mentioned ultra high-pressure mercury lamp.

The luminous efficacy (a luminous flux per unit input electric power to a lamp) of the metal halide lamp of the embodiment 1 was 93 lm/W. The aforementioned experimental metal halide lamp had a luminous efficacy of 80 lm/W. Although the improvement in the luminous efficacy might appear to be relatively small over the experimental metal halide lamp, the lamp of the embodiment 1 had approximately three times as high maximum luminance as the experimental metal halide lamp. Moreover, the lamp of the embodiment 1 achieved approximately three times as high projection efficiency as that of the experimental metal halide lamp. That is, assuming that the same input power is applied to these two metal halide lamps, the lamp of the embodiment 1 achieves approximately three times as high illuminance at the screen as that of the experimental metal halide lamp. That is an approximately equal projection efficiency to that of the aforementioned ultra high-pressure mercury lamp.

It is noted that the 'projection efficiency' herein means that the luminous flux per unit input voltage to a lamp that reaches the screen when a light is projected with an taking angle of 7 degrees onto a 40-inch screen via an ellipsoidal reflector.

The reason for achieving such high luminance and high projection efficiency is considered to be as follows. The lamp of the embodiment 1 does not comprise the metal elements having relatively low ionization potentials as a simple body, such as Na (ionization potential of Na is 5.14 eV) and In (ionization potential of In is 5.79 eV), and instead, comprises only the metal elements with an ionization potential of 6 eV or higher, such as Sc (Ionization potential of Sc is 6.7 eV) and mercury ionization of Hg is 10.44 eV). In addition, the distance between the two electrodes is set at a short distance of 2.5 mm. Therefore, the lamp is capable of generating stable arc with a small diameter. As a result, the generated arc retains high energy density and high temperature, and therefore the amount of light emission per unit Sc atom is increased even if there is no large increase in vapor pressure as seen in the case where complex iodides are formed. Hence, the amount of light emission per unit area is increased, resulting in such high luminance and high projection efficiency as in the above description.

Moreover, in the lamp of the embodiment 1, the distance between the inner wall of the arc tube 201 and the electrodes

202 is set at approximately twice the distance between the electrodes 202, and thereby the damage to the arc tube 201 can be avoided.

Further, having arc with a small diameter, the lamp of the embodiment 1 has a narrow current path and thereby has high voltage between the electrodes. Consequently, the electric current required for the same input power as prior art metal halide lamps can be reduced in the lamp of the embodiment 1. Hence, the operational life of the lamp is not deteriorated even when the distance between the electrodes is made short.

Figure 3:
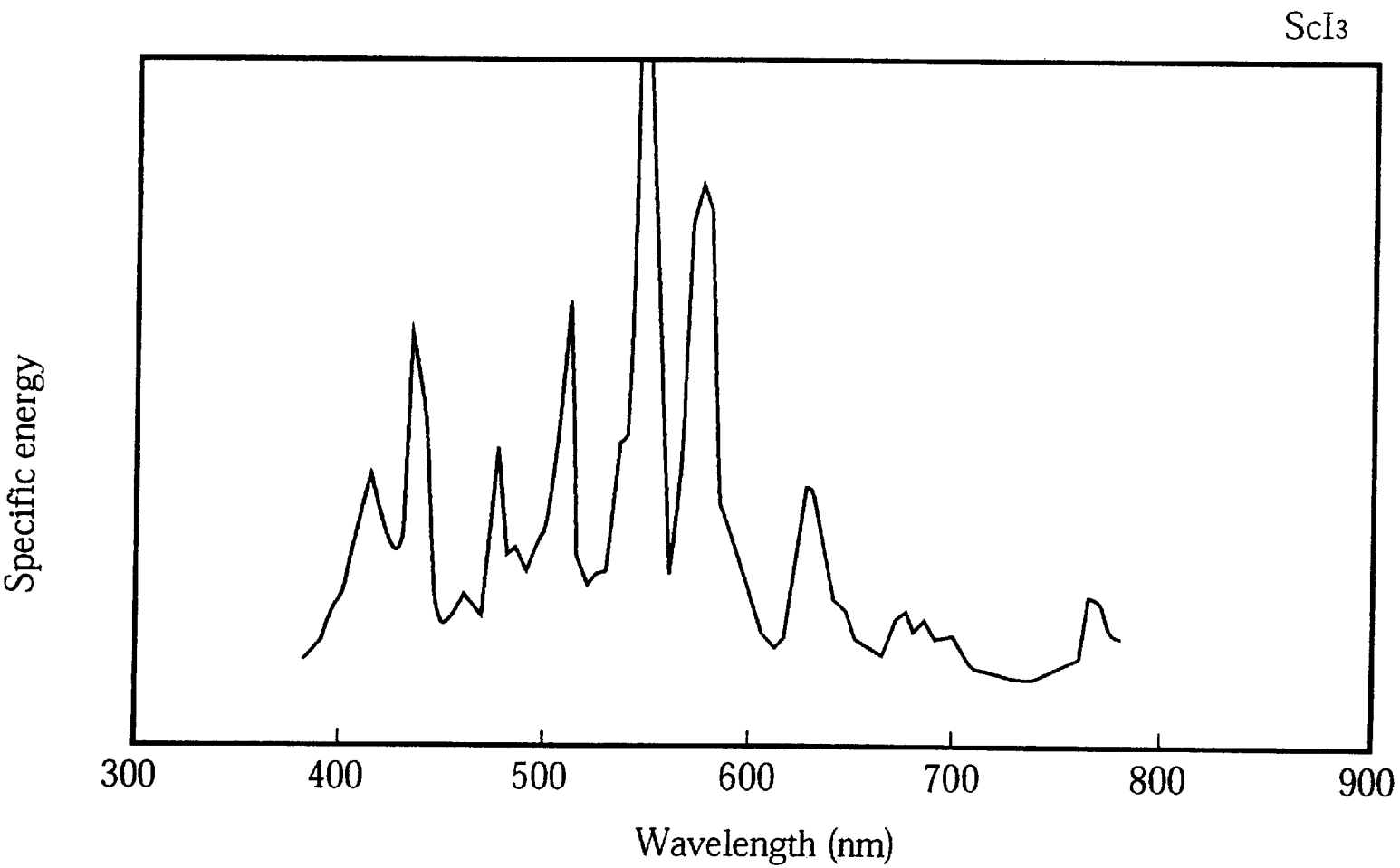
FIG. 3 is a graph illustrating the spectral distribution characteristic of the metal halide lamp of the embodiment 1 in accordance with the present invention.
Figure 4:
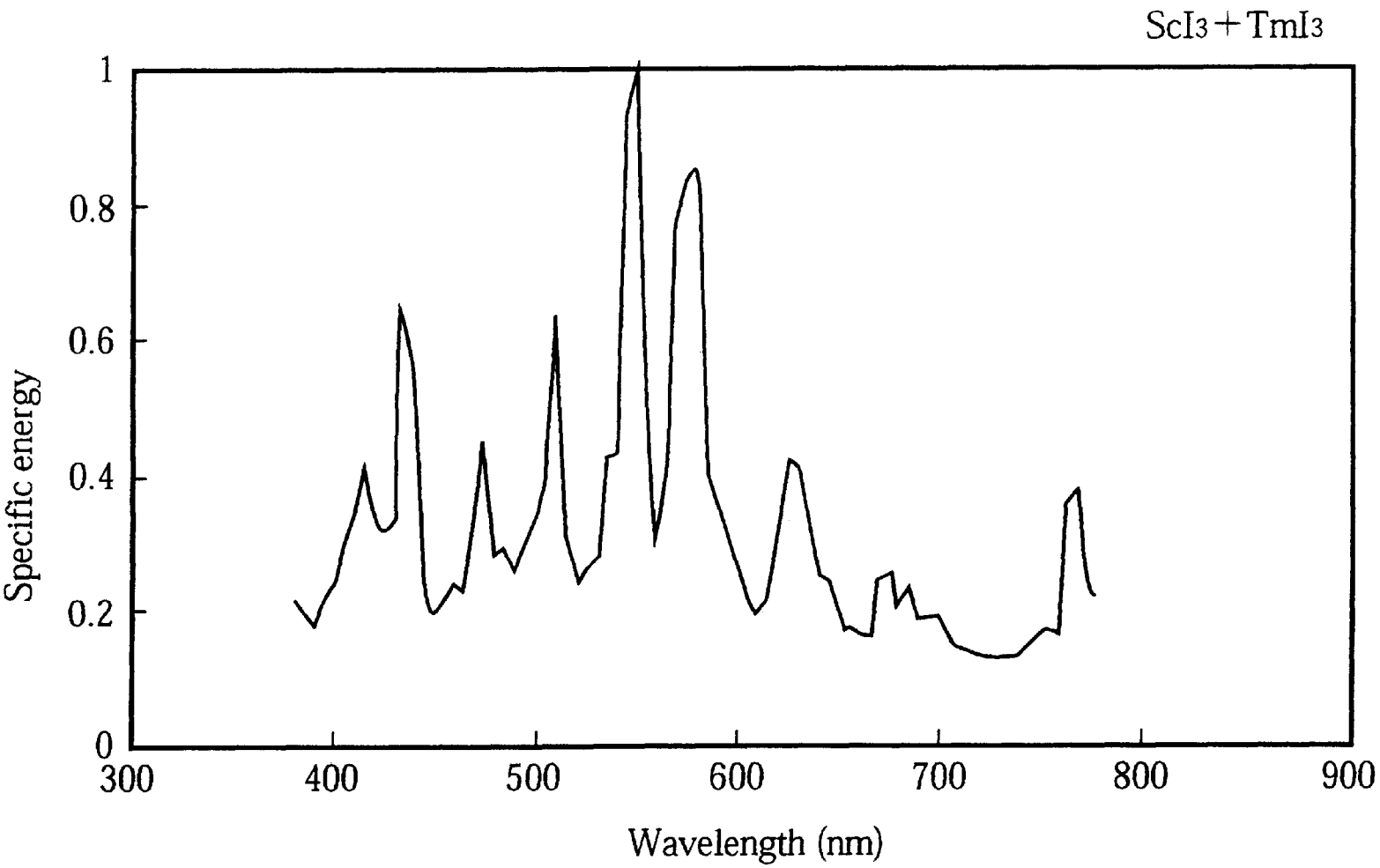
FIG. 4 is a graph illustrating the spectral distribution characteristic of the metal halide lamp of the embodiment 2 in accordance with the present invention.
Figure 10:
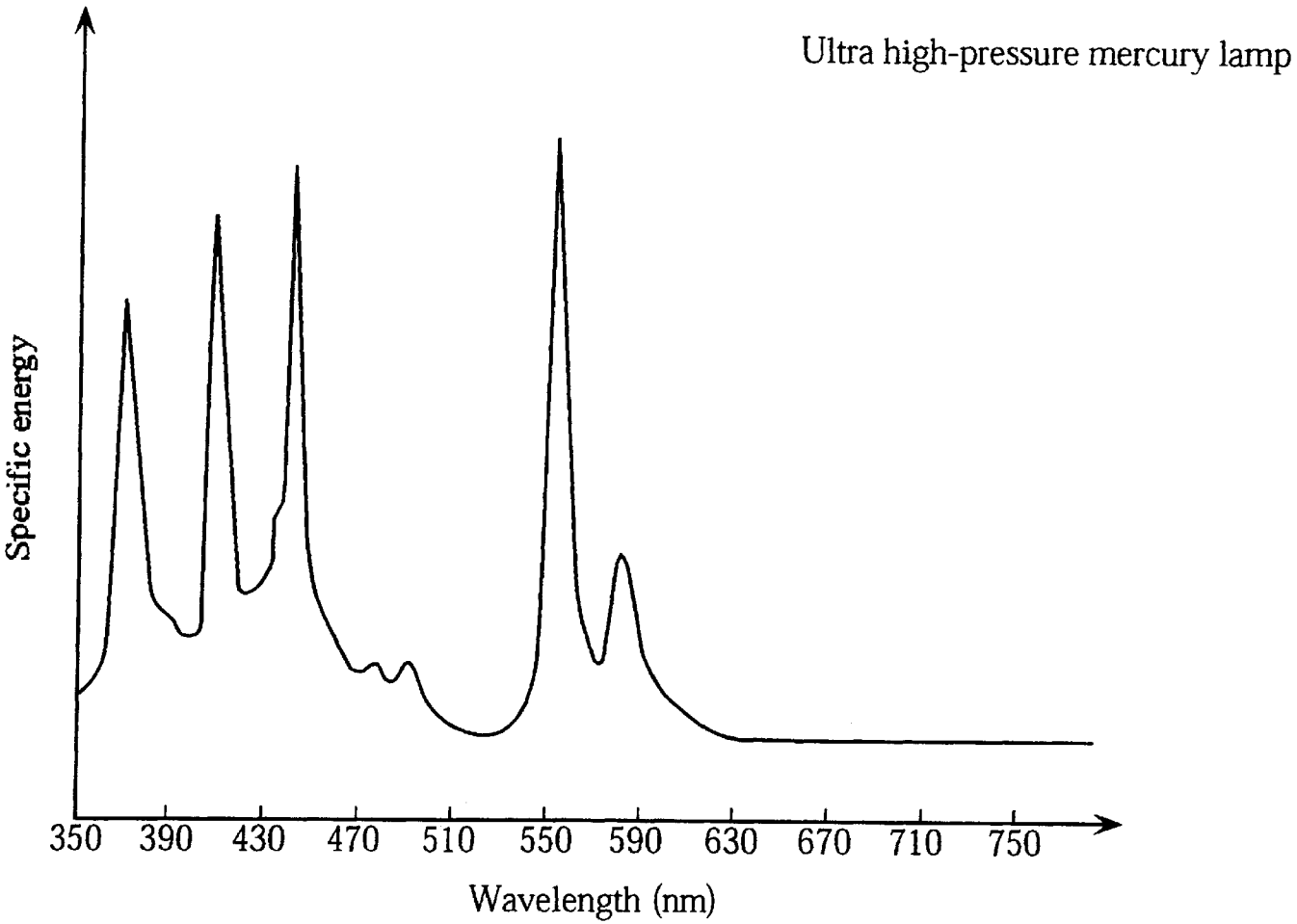
FIG. 10 PRIOR ART
FIG. 10 is a graph illustrating the spectral distribution characteristic of a conventional ultra high-pressure mercury lamp.

Now referring to FIG. 3, there is shown the spectral distribution characteristic of the lamp of the embodiment 1. As seen from FIG. 3, the lamp had light emission over the whole visible range of spectrum. In particular more abundant light emission was observed in red color region of spectrum, the wavelength range of 600 to 650 nm, compared to the aforementioned ultra high-pressure mercury lamp (the spectral distribution is shown in FIG. 10). This is due to the light emission around 630 nm resulting from the effect of Sc. In this embodiment, the above-described light emission effect by Sc is relatively larger than in the case where Na is included in the fill material. Hence, the lamp of the embodiment 1 exhibits more favorable color rendering properties than the aforementioned ultra high-pressure mercury lamp and the metal halide lamp in which Na is included in the fill material.

It is to be noted that the distance between the electrodes 202 is not limited to 2.5 mm. As the distance is made sorter (e.g., 2 mm or shorter), the resulting luminance and the like becomes higher.

It is also to be noted that it is preferable to set the distance between the inner wall of the arc tube 201 and the electrodes 202 at not less than approximately 1.5 times the distance between the electrodes 202, to avoid the damage to the arc tube 201 and to obtain stable arc in the case of a large input power.

Embodiment 2

The metal halide lamp of the embodiment 2 has the same construction except that $TmI_3$, is added to the fill material and that the distance between the electrode is set at 2.2 mm.

The measurement was carried out according to the same conditions as in the embodiment 1. The metal halide lamp of the embodiment 2 had an arc diameter of 0.7 mm and a luminous efficacy of 93 lm/W, which were the same values as in the embodiment 1. The maximum luminance was approximately 2.7 times that of the experimental metal halide lamp. It is understood from these results that the addition of $TmI_3$ does not incur a large arc diameter and high luminance and high projection efficiency can be therefore obtained.

As to the spectral distribution, the lamp of the embodiment 2 can achieve even more abundant light emission over the whole visible range, particularly in the red color region, the wavelength range of 600 to 650 nm. This is due to the fact that Tm (thulium) results in light emission over the whole visible range. Therefore, the lamp of the embodiment 2 can achieve further favorable color rendering properties than the metal halide lamp of the embodiment 1.

It is considered that rarer elements other than Tm also have the same effect on the arc diameter as Tm. Considering this, it is also made possible to provide the metal halide lamp with high luminance and favorable color rendering properties by adding halides of rare-earth elements such as holmium and erbium ($HoI_3$, $ErI_3$, and the like) to the fill material, since these halides exhibit the light emission over the whole visible range as seen in Tm.

Embodiment 3

The metal halide lamp of the embodiment 3 has the same construction as the lamp of the embodiment 1, except that the lamp has dimensions as specified below.

| | |
|---|---|
| Inner diameter of the arc tube: | 12.0 mm |
| Inner capacity of the arc tube: | 1.0 cc |
| Distance between the electrodes: | 1.3 mm |
| Distance between the inner wall of the arc tube and the electrodes: | Approx. 6.0 mm |

The fill material comprises the same material as in the embodiment 1.

The measurement for a lamp constructed in accordance with the above-described manner was carried out with an input power of 200 W, according to the same conditions as in the embodiment 1. This lamp of the embodiment 3 also exhibited high luminance and high projection efficiency.

Figure 5:
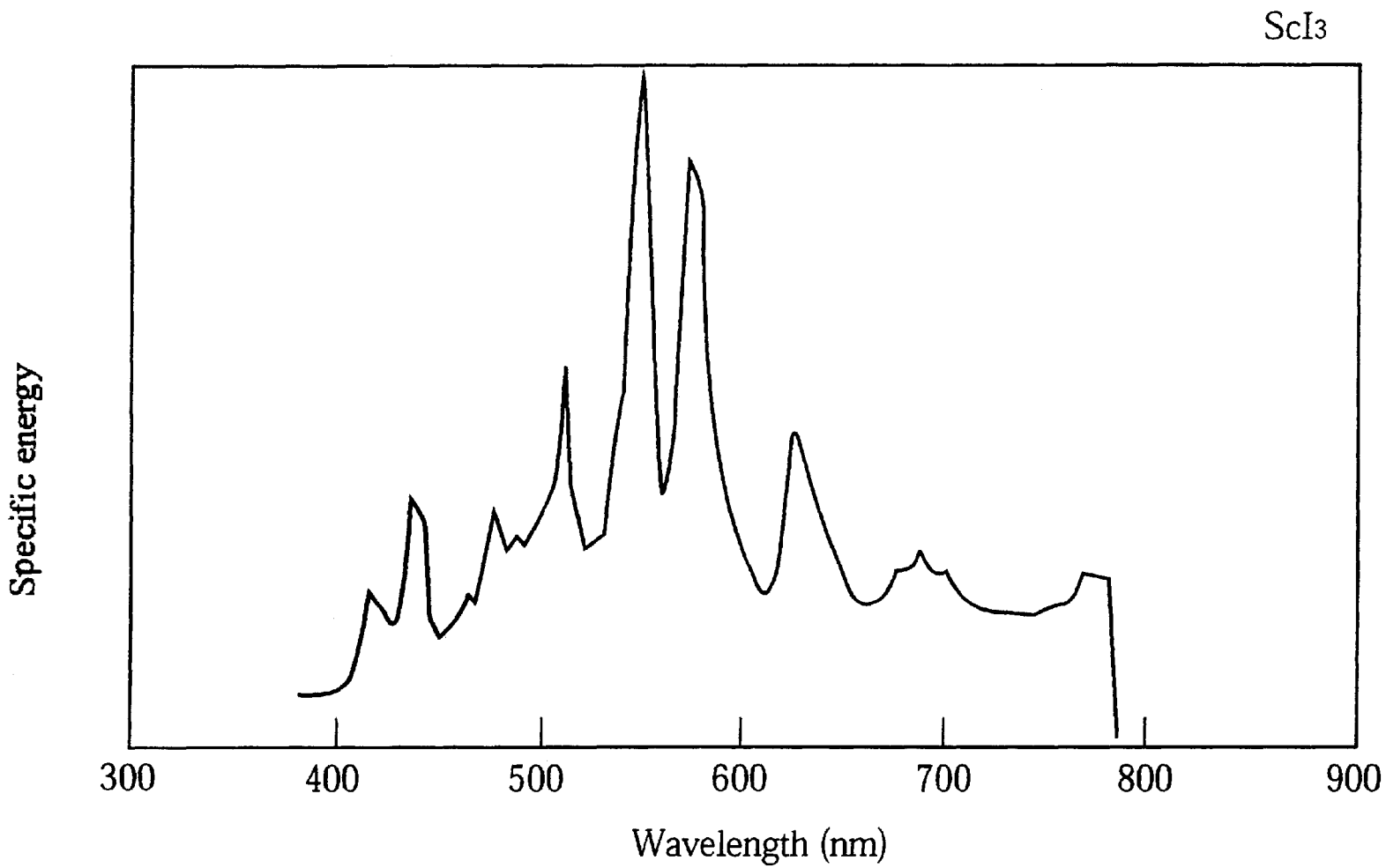
FIG. 5 is a graph illustrating the spectral distribution characteristic of the metal halide lamp of the embodiment 3 in accordance with the present invention.

The spectral distribution of this lamp is shown in FIG. 5. FIG. 5 illustrates that the lamp of the embodiment 3 also exhibits a favorable color rendering properties.

Embodiment 4

The metal halide lamp of the embodiment 4 has the same construction as the embodiment 3, except that $SCBr_3$ (scandium bromide) is employed in place of $ScI_3$ (scandium iodide) and that the distance between the electrodes is set at 1.9 mm.

The measurement for this lamp was carried out according to the same conditions as in the embodiment 1, except that the input power was 250 W. The lamp of the embodiment 4 also exhibited high luminance and high projection efficiency.

Figure 6:
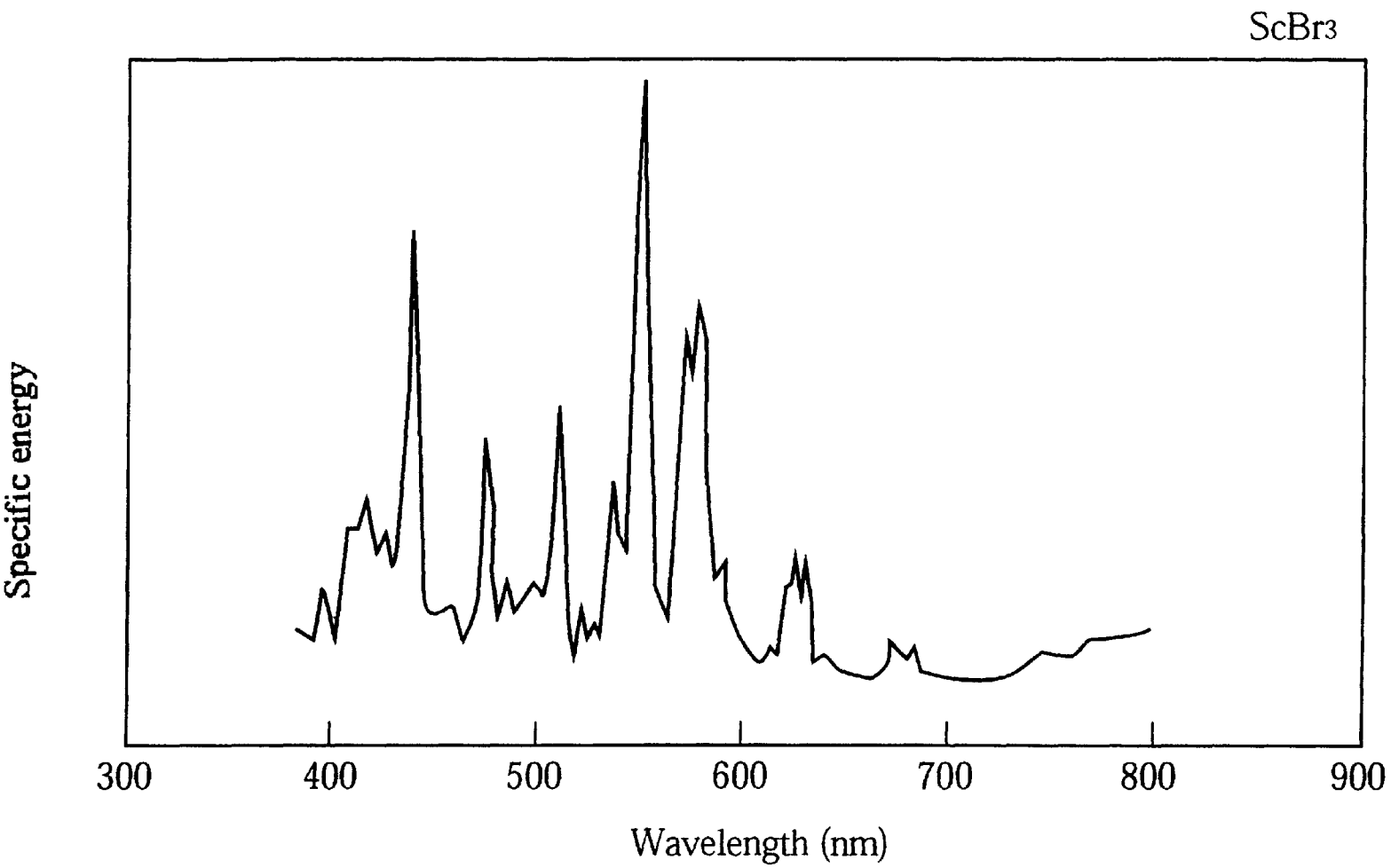
FIG. 6 is a graph illustrating the spectral distribution characteristic of the metal halide lamp of the embodiment 4 in accordance with the present invention.
Figure 7:
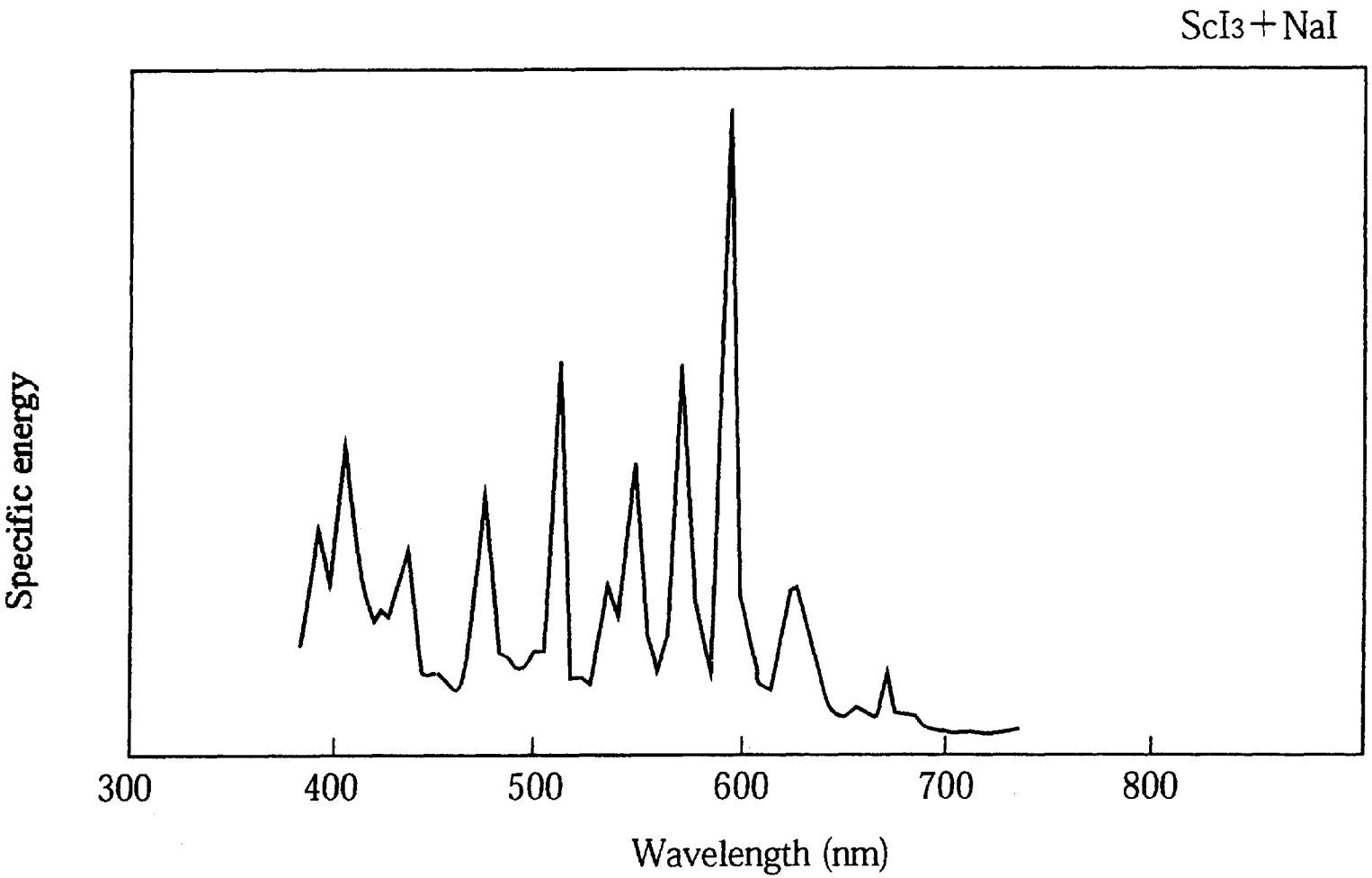
FIG. 7 PRIOR ART
FIG. 7 is a graph illustrating the spectral distribution characteristic of a prior art metal halide lamp.
Figure 8:
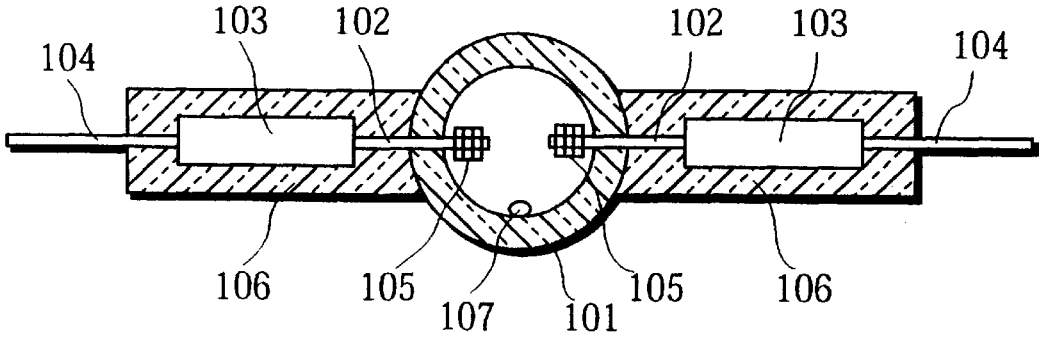
FIG. 8 is a cross-sectional view showing the construction of the metal halide lamp produced as an experimental product in the process of completing the present invention.
Figure 9:
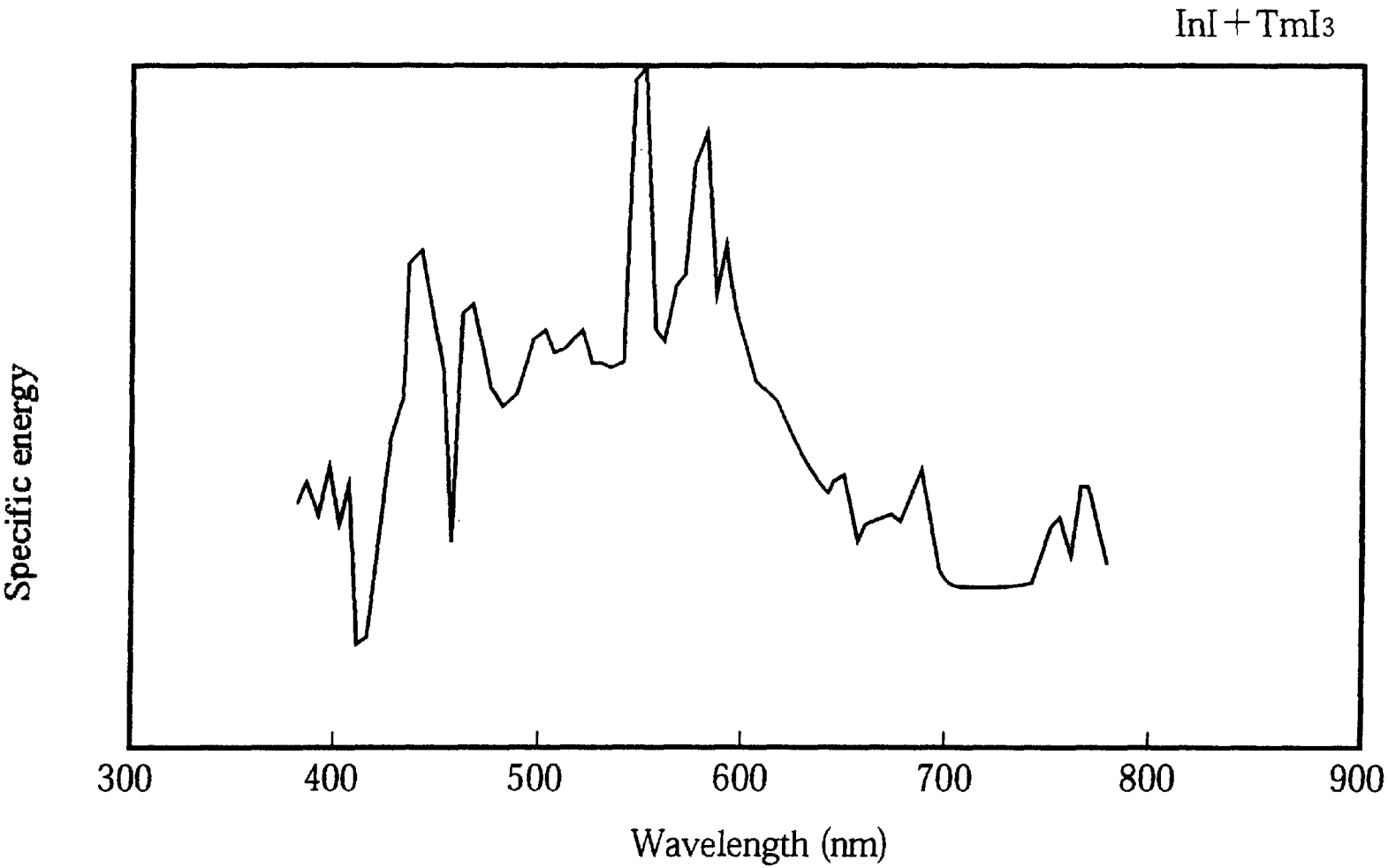
FIG. 9 is a graph illustrating the spectral distribution characteristic of the metal halide lamp of the above-mentioned experimental product.

The spectral distribution of this lamp is shown in FIG. 6. FIG. 6 illustrates that the lamp of the embodiment 4 also exhibits further well-balanced light emission over the whole visible range than the metal halide lamp of the embodiment 3.

It is to be understood that the same degree of luminances and spectral distributions as in the above embodiments can be obtained by applying a voltage with direct current component although an alternating voltage with rectangular waves is used in the above embodiments.

Although the present invention and its advantages have been described in detail, it should be understood that various changes, substitutions, and alterations can be made herein without departing from the spirit and scope of the invention as defined by the appended claims.

What is claimed is:

1. A metal halide lamp comprising:

an arc tube having gas-tight inner walls, the tube further comprising a pair of electrodes each having a terminal end, wherein the distance between terminal ends is less than 2.0 mm and the distance between the inner walls and each terminal end is equal to, or greater than 1.5 times the distance between terminal ends; and light emitting fill material, inside the arc tube, the fill material comprising a rare gas, mercury, and a non-mercury metal having a first ionization potential equal to, or greater than 6 eV, and no metals having a first ionization potential less than 6 eV.

2. A metal halide lamp as in claim 1, wherein said fill material includes scandium and halogen.

3. A metal halide lamp as in claim 2, wherein said fill material includes scandium halide.

4. A metal halide lamp as in claim 3, wherein said scandium halide is scandium iodide ($ScI_3$).

5. A metal halide lamp as in claim 3, wherein said scandium halide is scandium bromide ($ScBr_3$).

6. A metal halide lamp comprising:

an arc tube having gas-tight inner walls, the tube further comprising a pair of electrodes each having a terminal end, wherein the distance between terminal ends allows stable electric discharge and the distance between the inner walls and each terminal end is equal to, or greater than 1.5 times the distance between terminal ends; and light emitting fill material, inside the arc tube, the fill material comprising a rare gas, mercury, and a non-mercury metal having a first ionization potential equal to, or greater than 6 eV, the non-mercury metal being thulium halide, and no metals having a first ionization potential less than 6 eV.

7. A metal halide lamp according to claim 6, wherein the fill material further comprises scandium halide.

8. A metal halide lamp according to claim 6, wherein the distance between terminal ends is less than 2 mm.

9. A metal halide lamp comprising:

an arc tube having gas-tight inner walls, the tube further comprising a pair of electrodes each having a terminal end, wherein the distance between terminal ends allows stable electric discharge and the distance between the inner walls and each terminal end is equal to, or greater than 1.5 times the distance between terminal ends; and light emitting fill material, inside the arc tube, the fill material comprising a rare gas, mercury, and a non-mercury metal having a first ionization potential equal to, or greater than 6 eV, the non-mercury metal being holmium halide, and no metals having a first ionization potential less than 6 eV.

10. A metal halide lamp according to claim 9, wherein the fill material further comprises scandium halide.

11. A metal halide lamp according to claim 9, wherein the distance between terminal ends is less than 2 mm.

12. A metal halide lamp comprising:

an arc tube having gas-tight inner walls, the tube further comprising a pair of electrodes each having a terminal end, wherein the distance between terminal ends allows stable electric discharge and the distance between the inner walls and each terminal end is equal to, or greater than 1.5 times the distance between terminal ends; and light emitting fill material, inside the arc tube, the fill material comprising a rare gas, mercury, and a non-mercury metal having a first ionization potential equal to, or greater than 6 eV, the non-mercury metal being erbium halide, and no metals having a first ionization potential less than 6 eV.

13. A metal halide lamp according to claim 12, wherein the fill material further comprises scandium halide.

14. A metal halide lamp according to claim 12, wherein the distance between terminal ends is less than 2 mm.

* * * * *